US005970456A

United States Patent [19]

Patillot et al.

[11] Patent Number: 5,970,456

[45] **Date of Patent: *Oct. 19, 1999**

[54] TRAFFIC INFORMATION APPARATUS COMPRISING A MESSAGE MEMORY AND A SPEECH SYNTHESIZER

[75] Inventors: Jean-Marc Patillot; Bernard De Vergnette, both of Rambouillet, France; Donald Zeegers, Waalre, Netherlands

[73] Assignee: Mannesman VDO AG, Frankfurt, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/631,383

[22] Filed: Apr. 12, 1996

[30] Foreign Application Priority Data

Apr. 20, 1995 [FR] France ..... 95 04737

[51] Int. Cl.[6] ..... G10L 3/00

[52] U.S. Cl. ..... 704/275; 704/270

[58] Field of Search ..... 395/2.77, 2.79, 395/2.75; 704/275

[56] References Cited

U.S. PATENT DOCUMENTS

| | | | |
|---|---|---|---|
| 5,086,510 | 2/1992 | Guenther et al. | 455/90 |
| 5,239,700 | 8/1993 | Guenther et al. | 455/158.4 |
| 5,357,595 | 10/1994 | Sudoh | 395/2.24 |
| 5,621,891 | 4/1997 | Ruhl | 395/2.79 |

FOREIGN PATENT DOCUMENTS

| | | |
|---|---|---|
| 0059880 | 9/1982 | European Pat. Off. . |
| 0495252A1 | 7/1992 | European Pat. Off. . |

OTHER PUBLICATIONS

Teruo Yasuhiro et al, "An Experimental Speech Synthesis System with Pre–Recorded Words and Phrases for Local Weather Reports", NHK Laboratories Note, pp. 2–14; Jan. 1980.

*Primary Examiner*—David R. Hudspeth
*Assistant Examiner*—Robert Louis Sax
*Attorney, Agent, or Firm*—Mayer, Brown & Platt

[57] ABSTRACT

The apparatus comprises a microcontroller (7) which receives codes representing vocabulary elements, a speech synthesizer (20) which generates, in analog form, phonemes for a loudspeaker (5) which correspond to the vocabulary elements represented by said codes, and a vocabulary memory (8, 23) which can be addressed by means of codes.

In accordance with the invention the memory contains, in correspondence with a given code, the ASCII characters of the word or the groups of words designated by this code, to be displayed on a display screen (10), as well as a sequence of digital data which defines the pronunciation thereof. The apparatus comprises means (22, 7, 21) for applying said sequence of digital data to the speech synthesizer (20) when the latter is to supply the loudspeaker (5) with the vocabulary element represented by the code. Moreover, a memory containing proper names and controlled in accordance with the invention is accommodated on a removable card (23).

10 Claims, 1 Drawing Sheet

TRAFFIC INFORMATION APPARATUS COMPRISING A MESSAGE MEMORY AND A SPEECH SYNTHESIZER

BACKGROUND OF THE INVENTION

The invention relates to a traffic information apparatus, comprising a vocabulary memory in which each vocabulary element can be addressed by means of a code number designating a vocabulary element, the memory containing, for each vocabulary element, digital data describing the relevant vocabulary element, and also comprising a speech synthesizer for generating the phonemes corresponding to the representation of said vocabulary elements in the form of speech.

An apparatus of this kind is, for example a car radio receiver, intended to receive and utilize so-called RDSITMC signals, or a road guidance apparatus which is also referred to as a navigation apparatus. It is capable of supplying traffic information messages, or messages for guiding a vehicle, by displaying the messages on a screen and/or by outputting the messages by speech synthesis.

A speech synthesizer is known from the document EP-A-0 059 880. According to this document, the definition of a word is given in the form of ASCII characters which are sequentially entered and a microcontroller interrogates a ROM memory containing pronunciation rules in order to establish how a given set of characters is to be pronounced. A problem is encountered in that in given languages several different pronunciation rules are applicable, depending on the words. For example, in English the characters "gh" in "rough" and "ghost" are not pronounced in the same way. In order to solve this problem, the speech synthesizer in the cited document utilizes a complex set of rules which must take into account a large number of different situations and which differs for different languages (English, German, French, etc.).

It is an object of the invention to simplify the generation of phonemes and to reduce the required memory.

SUMMARY OF THE INVENTION

To this end, the traffic information apparatus in accordance with the invention is characterized in that for at least some vocabulary elements the memory contains the alphanumerical characters of the relevant vocabulary element as well as a sequence of digital data which defines the pronunciation of the relevant vocabulary element, and that the apparatus comprises means for reading said sequence of digital data in the memory and for applying it to the speech synthesizer.

Inter alia the complex set of rules used in prior art can thus be dispensed with.

The invention is based on the idea that the number of words required in a message system for cars is much smaller than the number of words in everyday language and that, even though the addition of digital data defining the pronunciation substantially doubles the size of the memory required for the vocabulary elements, in this case such doubling is not objectionable whereas it would be prohibitive in the case of a universal speech synthesizer. The gain in memory space resulting from elimination of the complex set of rules is much larger than the increase of the size of the vocabulary memory in the application envisaged herein.

Preferably, at least a part of the vocabulary memory is accommodated on a removable card.

Because the phonetic transcription of pronunciation data is independent of the language, the format of the card may be standardized so that the apparatus can be adapted to different countries simply by replacing the card.

This is particularly advantageous for proper names whose pronunciation is often problematic; for example, in French the family name "de Broglie" and the name of the town "Broglie" are pronounced differently. Therefore, the memory preferably contains names of location points with the alphanumerical characters of these names as well as a sequence of digital data which defines their pronunciation, the part of the memory containing names of location points being accommodated on a removable card.

These and other aspects of the invention will be apparent from and elucidated with reference to the embodiments described hereinafter.

DESCRIPTION OF THE PREFERRED EMBODIMENTS

The following description relates to a car radio intended to receive and utilize so-called RDS/TMC signals. It will be evident to those skilled in the art that this description can be adapted to the case of a navigation or road guidance apparatus, for example of the type known as "CARIN" or "CARMINAT" or "SOCRATES", and also that the part in which the invention is implemented may be similar in a car radio and a navigation apparatus.

Figure 1:
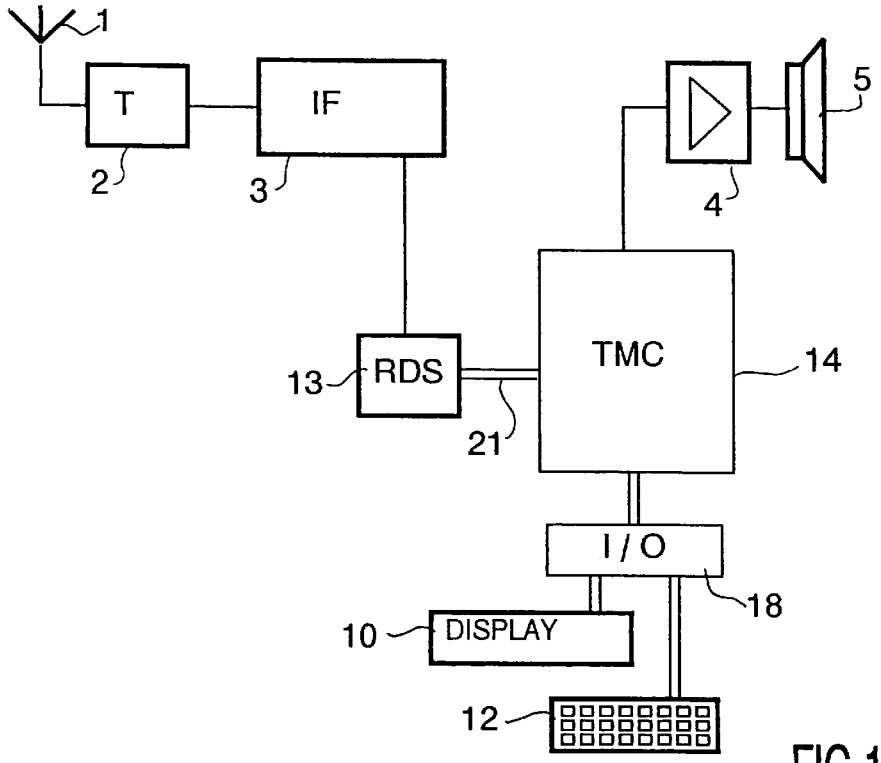
FIG. 1 shows diagrammatically a car radio receiver in accordance with the invention.

Subsequent to an aerial 1, the receiver shown in FIG. 1 comprises a device 2 (tuner) which comprises a tuning circuit and a frequency control circuit, followed by a device 3 which comprises an intermediate frequency amplifier and a demodulator.

In the so-called RDS (Radio Data System) process an FM subcarrier is modulated by digital data signals for the reception of various stations of the same chain. For the processing of these signals the receiver comprises a decoder 13 for RDS messages.

In the case of the so-called TMC (Traffic Message Channel) process, information messages concerning traffic are incorporated in given digital fields of the RDS signals, for example "traffic jam three kilometres before Paris entrance". For the processing of the TMC messages the receiver comprises a module 14 whereto the RDS data from the decoder 13 are applied, via a bus 21, so as to be analyzed and possibly stored. In order to enable output of the messages in the form of speech, the module 14 is also connected to a audio amplifier system 4 which is followed by a loudspeaker 5. It is also connected to an input/output interface 18 which is connected to a control keyboard 12 and to a display screen 10, for example a liquid crystal display screen.

The standard TMC messages are formed by several digital data fields, received in the RDS data, which designate the vocabulary elements by means of a code number:

- a first field, comprising 11 bits, which contains the code number of a vocabulary element (word or group of words) describing an event,
- a second field, comprising 16 bits, which contains the code number of a vocabulary element defining the location whereto the relevant event relates, a third field, comprising 3 bits, which contains information describing an extension of the location concerned, a fourth field, comprising 1 bit, which describes the direction of the route concerned, a fifth field, comprising 3 bits, which provides the duration of the validity of the message, a sixth field, comprising 1 bit, which indicates whether or not it is recommended to take a detour.

The contents of each field must be processed so as to express in plain form what is concerned. To this end, there is provided a permanent memory in which information is stored in plain form (for example as ASCII codes of characters of a message to be displayed) at addresses corresponding to the different possible contents of each field, thus enabling the retrieval of the information on the basis of the contents of a field.

For example, the first field (describing an event), comprising 11 bits, is associated with a memory which can contain 2048 vocabulary elements in plain form (so $2^{11}$ vocabulary elements), each of which is found at the address defined by the contents of the field. These vocabulary elements say, for example "traffic jam", "roadwork ahead", "accident", etc.

The second field (describing a location), comprising 16 bits, is associated with a memory which is referred to as a location point memory and which is capable of containing as many as 65536 vocabulary elements in plain form (so $2^{16}$ vocabulary elements) which comprise complete data concerning notably the placenames, their type, the region in which they are situated, the next points and preceding points etc., each vocabulary element in principle being found at an address designated by the contents of the field. These vocabulary elements are, for example "Paris" or "Lille" or "exit 21", etc. For each country concerned there are defined several different databases of 65536 elements each for selection in conformity with the application. The country concerned is indicated in a so-called PI code of the RDS data, and the reference of the database chosen is indicated in a "system message" emitted from time to time by every RDS/TMC transmitter.

In the third field various types of extensions are defined. An extension is to be understood to mean that the event considered extends, for example as far as the next location.

In the fourth field a 0 bit signifies, for example "direction Paris→Lille", whereas a 1 bit signifies "direction Lille→Paris" (the contents of field 2 reveal that a link between Paris and Lille is concerned, but the direction still fails).

Figure 2:
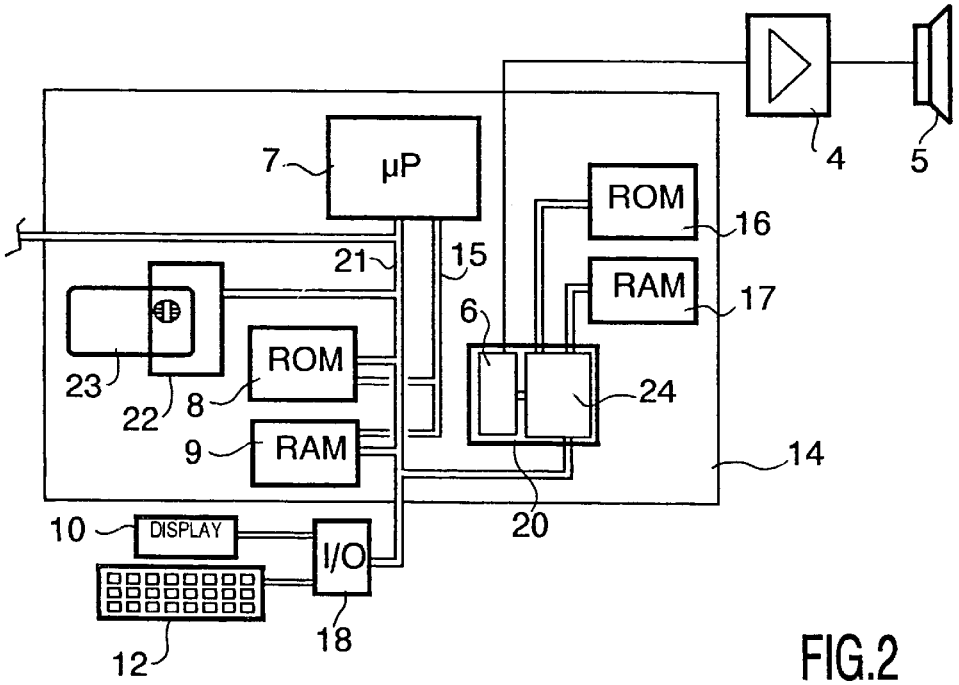
FIG. 2 is a more detailed representation of the part whereto the invention relates as well as of its connections to the remainder of the apparatus.

Referring to FIG. 2, the module 14 comprises a microcontroller 7 which generates control signals and processes the signals supplied by the various devices whereto it is connected by means of an address bus 15 and a data bus 21. The module 14 also comprises several memories:

a volatile memory 9 which is a so-called "RAM" for the storage of data validated at a given instant, a permanent memory 8 for storing vocabulary descriptions fixed once and for all via the TMC standard in correspondence with given fields, for example the first field, and a memory 22, 23 which is formed by a memory card reader 22 and a removable memory card 23, for example of the type PCMCIA, in which notably the data corresponding to the second TMC data field are stored, i.e. for each of the names of locations provided for a given country, its spelling in, for example ASCII characters, and the sequence of phonemes corresponding thereto, said data thus corresponding to a given group of users and/or a given region.

The microcontroller 7 selects and prepares the digital data, for example a sequence of codes, each of which designates a phoneme, thus enabling a known speech synthesizer module 20 to generate the phonemes in the form of analog signals which are applied to the audio amplifier 4 which is followed by the loudspeaker 5. It will be recalled that a phoneme is a unit of sound of a language. The cited document EP-A-0 059 880 teaches that there are 40 phonemes in English, but it advises the use of 127 "allophones" which are sub-assemblies of phonemes, modified by their environment, and offer more exact representation of sounds. The number of phonemes can thus vary in dependence on the quality desired. Regardless thereof, the number of different descriptions of phonemes is not very large and, generally speaking, is of the order of magnitude of some tens of phonemes which are defined in advance as "standard phonemes".

On the basis of the codes of these standard phonemes, the speech synthesizer module 20 applies the desired analog signals to the audio amplifier 4 followed by the loudspeaker 5. The module 20 comprises inter alia:

its own microcontroller 24, a volatile memory 17, being a so-called "RAM", inter alia for the temporary storage of codes, designating a respective phoneme, which are supplied by the microcontroller 7 and on the basis of which the module 20 generates the phonemes, and a permanent memory 16, for example a so-called "ROM", in which there are stored, in correspondence with each of the codes designating a phoneme, successive amplitude samples of an analog signal intended for the audio amplifier. The desired samples are read one by one by the microcontroller 24 at a sampling rate of, for example 8 kHz, after which they are converted in an analog-to-digital converter 6 so as to generate an analog signal for the audio amplifier 4.

When a TMC message arrives, the microcontroller 7 receives the contents of the fields from the RDS decoder 13 and writes the contents in the memory 9. For the display on the screen 10 and/or the output of this message in the form of speech, the microcontroller 7 fetches at least the contents of the fields 1, 3, 4 from the memory 9 and interprets these contents in known manner, inter alia by reading in the memory 8 the constituents of the message to be produced so as to announce the corresponding event in the form of, for example codes describing the corresponding representations. The microcontroller subsequently fetches the second field from the memory 9, deduces an address in the memory 23 therefrom in order to read in this memory on the one hand the spelling of the name of the corresponding location and on the other hand the constituent phonemes. It inserts the spelling at the appropriate areas in the message to be reproduced so as to announce the event and inserts the phonemes in the appropriate positions in the sequence of the phoneme codes applied to the module 20.

What is claimed is:

1. A traffic information apparatus, comprising a vocabulary memory which contains descriptions of vocabulary elements, in which each vocabulary element description can be addressed by means of a code number designating a vocabulary element, the memory containing, for each vocabulary element, digital data describing the relevant vocabulary element, and a speech synthesizer for generating the phonemes corresponding to the representation of said vocabulary elements in the form of speech, characterized in that for at least some vocabulary elements, the memory contains the alphanumerical characters of the relevant vocabulary element as well as a sequence of digital data which defines the pronunciation of the relevant vocabulary element, and the apparatus comprises means for reading said sequence of digital data in the memory and for applying it to the speech synthesizer.

2. A traffic information apparatus as claimed in claim 1, characterized in that the memory contains names of location points with the alphanumerical characters of these names as well as a sequence of digital data which defines their pronunciation.

3. A traffic information apparatus as claimed in claim 1, characterized in that at least a part of the vocabulary memory is accommodated on a removable card.

4. A traffic information apparatus as claimed in claim 3, characterized in that the removable card contains the data concerning the names of location points.

5. A module for generating traffic information messages which comprises, or is connected to, a vocabulary memory and means for reading therein digital data which constitute the description of vocabulary elements, each vocabulary element description being addressable by means of a code number designating a vocabulary element, characterized in that it comprises means for reading in the memory, for at least some vocabulary elements, on the one hand the alphanumerical characters of the relevant vocabulary element and on the other hand a sequence of digital data which defines the pronunciation of the relevant vocabulary element.

6. A module for generating traffic information messages as claimed in claim 5, characterized in that it comprises means for reading in the memory names of location points with the alphanumerical characters of these names as well as a sequence of digital data which defines their pronunciation.

7. Apparatus for generating speech comprising:

a. a computer readable medium embodying a vocabulary data structure comprising a plurality of vocabulary elements, the data structure storing for each vocabulary element at least i. a first respective field containing at least one respective alphanumeric character code corresponding to that vocabulary element; and ii. a second respective field containing at least one respective digital pronunciation code corresponding to that vocabulary element;

b. means, responsive to a selection of a particular vocabulary element, for reading the second respective field corresponding to the particular vocabulary element;

c. a speech synthesizer, responsive to the reading means, for generating a single respective phoneme for each respective pronunciation code in an output signal of the reading means.

8. The apparatus of claim 7 wherein the apparatus is for generating traffic information and at least one of the vocabulary elements is a place name.

9. A computer readable medium embodying a vocabulary data structure a plurality of vocabulary elements, the data structure comprising, for each vocabulary element, a. a first respective field containing at least one respective alphanumeric character code corresponding to that vocabulary element; and b. a second respective field containing at least one respective digital pronunciation code corresponding to that vocabulary element, which pronunciation code is different from a corresponding character code in the first field and which pronunciation code unambiguously specifies a single respective phoneme with respect to which the corresponding character code is ambiguous, the single respective phoneme being for output by a speech synthesizer.

10. The medium of claim 9 arranged for insertion into a traffic information device wherein at least one of the first respective fields stores a place name.

* * * * *

UNITED STATES PATENT AND TRADEMARK OFFICE

CERTIFICATE OF CORRECTION

PATENT NO : 5,970,456

DATED : October 19, 1999

INVENTOR(S) : Patillot et al.

It is certified that error appears in the above-identified patent and that said Letters Patent are hereby corrected as shown below:

In the claims, column 6, line 20, the phrase

"...data structure a plurality of ..."

should read

--... data structure, comprising a plurality of ...--

Signed and Sealed this

Third Day of April, 2001

*Attest:*

NICHOLAS P. GODICI

*Attesting Officer*

*Acting Director of the United States Patent and Trademark Office*